US007878704B2

(12) United States Patent
Bonnard

(10) Patent No.: US 7,878,704 B2
(45) Date of Patent: Feb. 1, 2011

(54) DOUBLE-CHAMBER MIXING DEVICE FOR VISCOUS PHARMACEUTICAL SUBSTANCES

(75) Inventor: Eric Bonnard, Liege (BE)

(73) Assignee: Uteron Pharma S.A. (BE)

( * ) Notice: Subject to any disclaimer, the term of this patent is extended or adjusted under 35 U.S.C. 154(b) by 448 days.

(21) Appl. No.: 11/915,118

(22) PCT Filed: May 23, 2006

(86) PCT No.: PCT/BE2006/000058

§ 371 (c)(1),
(2), (4) Date: Nov. 20, 2007

(87) PCT Pub. No.: WO2006/125284

PCT Pub. Date: Nov. 30, 2006

(65) Prior Publication Data

US 2008/0212399 A1 Sep. 4, 2008

Related U.S. Application Data

(60) Provisional application No. 60/684,338, filed on May 24, 2005.

(51) Int. Cl.
*B01F 13/00* (2006.01)

(52) U.S. Cl. ..... 366/268; 366/149

(58) Field of Classification Search ..... 366/130, 366/149, 189, 267–269, 336–341; 604/82, 604/416, 903; 206/219, 222
See application file for complete search history.

(56) References Cited

U.S. PATENT DOCUMENTS 2,477,598 A * 8/1949 Hain ..... 366/334
2,724,383 A * 11/1955 Lockhart ..... 604/88
2,798,488 A * 7/1957 Hall ..... 604/82
3,010,705 A * 11/1961 Brown ..... 366/268
3,035,820 A 5/1962 Todd et al.
3,190,619 A * 6/1965 Knittel et al. ..... 366/129
3,353,918 A 11/1967 Perrin
3,700,215 A * 10/1972 Hardman et al. ..... 366/268
3,860,218 A * 1/1975 Hurlimann ..... 366/268
4,347,002 A * 8/1982 Born ..... 366/6
4,350,650 A * 9/1982 Cereghini ..... 264/39
4,463,875 A * 8/1984 Tepic ..... 222/82

(Continued)

OTHER PUBLICATIONS

International Search Report from International Application No. PCT/BE2006/000058 dated Aug. 16, 2006.

*Primary Examiner*—Charles E Cooley
(74) *Attorney, Agent, or Firm*—Knobbe Martens Olson & Bear LLP

(57) ABSTRACT

The invention concerns a double-chamber device for mixing at least two viscous substances, comprising: cylindrical and coaxial first and second communicating vessels, each hermetically sealed at one end by a mobile piston, and provided at its second end with a slightly conical bottom end, the two vessels being arranged, preferably vertically, in mirror symmetry relative to a meridian plane perpendicular to their common axis; a central mixing element connecting the two vessels at the two slightly conical bottom ends; and a high pressure hydraulic device for automatically activating the pistons in a coordinated reciprocating movement. A worm screw injection device in communication with one of the vessels or with the mixing element may be used to inject the substances. Mixing of substances may include driving the pistons in a coordinated reciprocal motion to collapse one vessel while expanding the other, forcing the substances through the central mixing element.

10 Claims, 2 Drawing Sheets

U.S. PATENT DOCUMENTS 4,832,500 A * 5/1989 Brunold et al. ..... 366/268
5,425,580 A * 6/1995 Beller ..... 366/131
6,062,722 A 5/2000 Lake
6,592,251 B2 * 7/2003 Edwards et al. ..... 366/268
6,799,884 B2 * 10/2004 Sentmanat ..... 366/176.3
2002/0182718 A1 * 12/2002 Malmquist ..... 435/287.2
2004/0120217 A1 6/2004 Sentmanat
2005/0270897 A1 * 12/2005 McCoy ..... 366/130

* cited by examiner

DOUBLE-CHAMBER MIXING DEVICE FOR VISCOUS PHARMACEUTICAL SUBSTANCES

RELATED APPLICATIONS

This application is a U.S. National Phase under 35 U.S.C. 371 of the International Patent Application No. PCT/BE06/000058, filed May 23, 2006, and published in French on Nov. 30, 2006 as WO 2006/125284, which claims the benefit of U.S. Provisional Application No. 60/684,338, filed May 24, 2005.

FIELD OF THE INVENTION

The present invention relates to a double-chamber mixing device allowing to achieve very good homogeneity in the case of a mixture of viscous substances, in particular in the pharmaceutical field.

The invention also relates to the method for implementing the device.

STATE OF THE ART

The incorporation of pharmaceutical substances in mixtures of high viscosity requiring perfect homogeneity is generally problematic with traditional mixing devices such as blade mixers, screw mixers, kneaders, planetary mixers and mixers with rotors/stators, etc.

Indeed, the following problems are most often encountered:

- losses and under-dosages of the products incorporated;
- lack of motion in the mixer because the products to be mixed stick to the mixing tools and to the tank wall;
- harmful increase of the temperature of the mixture causing degradation of the products mixed;
- losses upon draining of the mixing tank or impossibility of automatic draining.

All these problems cause a lack of homogeneity of the mixture obtained that is not compatible with the strict quality requirements of a pharmaceutical finished product or may even cause the impossibility of producing the desired mixture.

Document US 2004/0120217 A discloses a method and apparatus for mixing a polymer with an agglomerate of one or several compounds in a pair of opposed pressure cylinders connected by a nozzle block between both cylinders and using the corresponding two pistons to force the transfer of the polymer and agglomerate from one cylinder towards the other and vice versa, in order to divide and disperse the agglomerate in the mixture with the polymer.

Document U.S. Pat. No. 3,353,918 A discloses an apparatus for mixing the manufacturing ingredients of polyurethane foam comprising a mixing device with two chambers having adjacent ends connected by a wall with passage apertures and two pistons, each piston being mounted and sliding in one of the two respective chambers, means for causing the oscillation of both pistons inside the chambers in order to force the ingredients in the mixing device according to a to-and-fro motion through the apertures and to mix them, said wall comprising an outlet passage provided with a control valve and communicating with the apertures, the mixed ingredients being dischargeable, once the pistons converge towards the wall and as long as the valve is open. The wall also comprises means provided with valves and communicating with the apertures for loading the ingredients in the mixing device.

Document U.S. Pat. No. 3,035,820 A discloses an apparatus for the emulsification and homogenization in a liquid of a solid or liquid viscous suspension (ex. water/oil), in which the suspension or mixture is forced to pass through a high-speed and/or high pressure restrictor. The apparatus comprises a pair of opposed cylindrical syringes, each having a piston mounted and sliding in its cylinder that can be actuated in order to repetitively transfer the fluid reciprocally from one syringe to the other through the restrictor connecting both cylinders.

Document U.S. Pat. No. 6,602,722 A discloses a method for mixing a fluid according to which one or two separated fluid reservoirs, communicating with a static helix blender, are used as a mixing apparatus. The fluid is forced to pass through the reservoir towards the static blender and vice versa.

SUMMARY OF THE INVENTION

The present invention aims to provide a solution that allows to overcome the drawbacks of the state of the art.

In particular, the present invention aims to provide a mixing device and method that allow to obtain a perfectly homogeneous mixture of viscous pharmaceutical substances.

The invention also aims to provide a mixing device and method that can be completely automated.

The invention additionally aims to provide a mixing method with a satisfactory result in less than 10 to 15 minutes.

The invention also aims to allow the mixing of thermosensitive pharmaceutical substances.

Lastly, the invention aims to create a mixing device allowing the complete draining of the tanks used.

Main Characteristic Elements of the Invention

A first aim of the present invention is to propose a double-chamber device for mixing at least two viscous substances, comprising:

- a first tank and a second tank, that are coaxial and cylindrical, each sealingly closed at a first end by a moving piston and provided at its second end with a slightly tapered bottom, both tanks being positioned, preferably vertically, in mirror-image symmetry relative to a plane that is perpendicular to their common axis;
- a central static mixing element connecting both tanks at the level of their slightly tapered bottoms;
- a high-pressure hydraulic device for automatically activating the pistons according to a coordinated reciprocal motion.

A second aim of the present invention is to propose a method for mixing at least two viscous substances, preferably pharmaceutical, by means of the above-mentioned device, characterised by the following stages:

- the substances to be mixed are injected into the first tank by withdrawing the piston or with a worm screw injection;
- a specified number of successive mixing cycles are achieved by pumping from the first tank to the second tank through the central static mixer, and vice versa;
- the final mixture is transferred to one of both tanks, which is then emptied.

Preferred embodiments of the present invention are described herein.

DESCRIPTION OF A PREFERRED EMBODIMENT OF THE INVENTION

The present invention relates to a mixing unit that allows the incorporation and automatic mixing of pharmaceutical products in a closed circuit with a view to obtain a final mixture of high viscosity.

The invented mixing unit comprises in the main two communicating, vertical and cylindrical tanks that are on the same axis and symmetrical relative to a median horizontal plane (both tanks being the mirror image of the other). These tanks are provided with sealed pistons which, when activated by a hydraulic system, allow the compounds to be mixed to pass in successive cycles through a mixing device with baffles. The assembly is totally automated by means of a programmable machine and may be thermostatically controlled for mixing thermosensitive substances requiring it.

Figure 1:
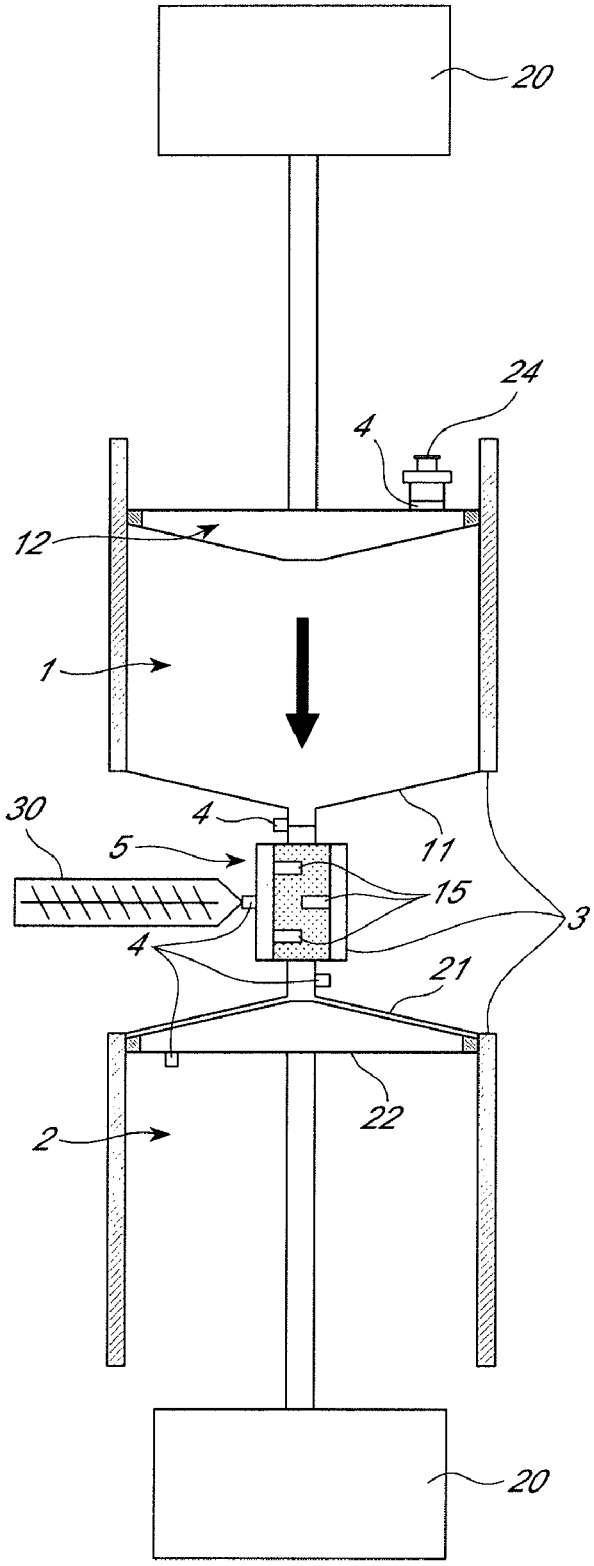
FIG. 1 represents a cross-section view of the mixing device according to a preferred embodiment of the present invention.

According to a preferred embodiment of the invention shown in FIG. 1, the mixing unit comprises the following elements:

1) a first upper tank 1, cylindrical with a vertical axis and made of stainless steel, and provided with:
   - a double casing 3 in which a cooling or heating fluid may circulate;
   - a slightly tapered bottom 11;
   - a stainless steel cover 12 acting as a piston whose shape, adapted to the tapered bottom of the tank, and seal allow the tank to be completely drained;
   - a high-pressure hydraulic device 20 that allows the automatic activation of the cover/piston;
   - various connections 4, possibly provided with valves, that allow to measure the temperature, to create vacuum or to introduce an inert gas, to take samples during mixing, to inject or remove substances, etc., where the connections 4 or similar connections elsewhere in the unit may be in communication with an injection and/or removal system 24 which may include a luer-lock type system and valves;
2) a second lower tank 2, cylindrical and vertical and made of stainless steel, that is coaxial with and identical to the first tank and positioned in mirror symmetry relative to the latter;
3) a mixing element 5 also made of stainless steel connecting both tanks 1,2 and provided with:
   - a double casing 3 in which a cooling or heating fluid may circulate;
   - a stainless steel element provided with baffles 15 (static mixer) allowing to create a turbulent mixing flow at the level of the compounds to be mixed;
   - various connections 4 allowing to measure the temperature, to create vacuum or to introduce an inert gas, to take samples during mixing, etc.;
4) a control device (not shown) allowing to control and synchronize the various motions of the pistons, the mixing cycles or even to inject the compounds for example by means of a worm screw 30, shown in FIG. 1 as being in communication with the mixing element 5, but which may alternately be in communication with one of the tanks 1 or 2.

The mixing and draining methods as in the invention are carried out as described below.

Figure 2:
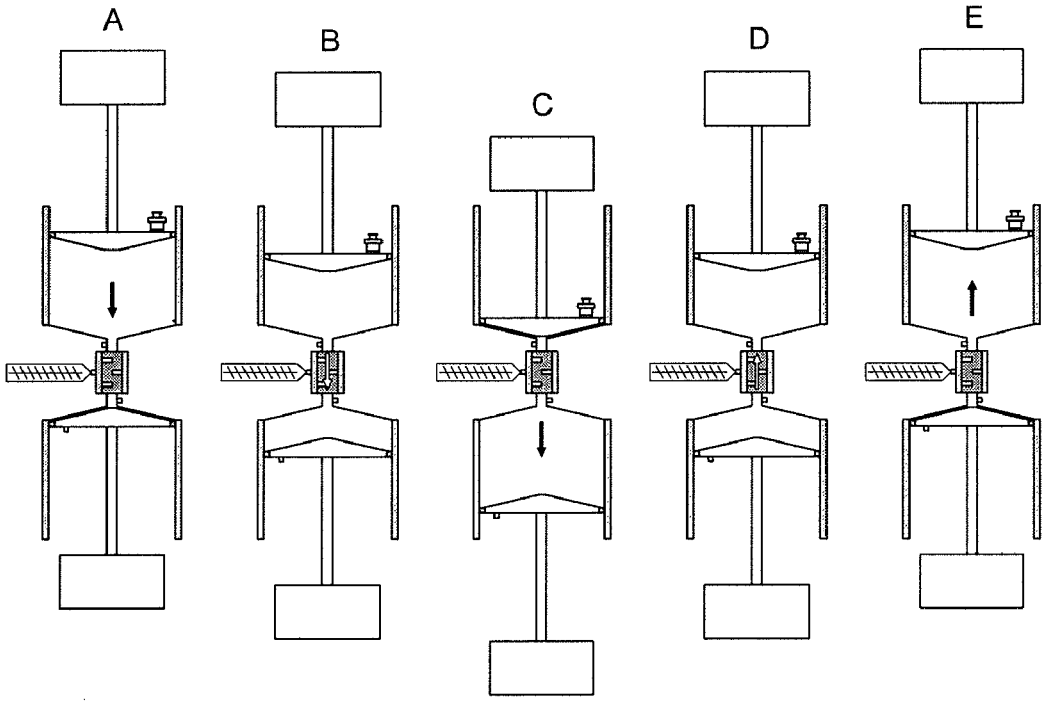
FIG. 2 diagrammatically represents the various stages for implementing the device as in FIG. 1.

The mixing method whose stages (a) to (e) are shown in FIG. 2 is carried out by pumping the compounds to be mixed in successive cycles from the upper tank 1 to the lower tank 2 through the static mixer 5, and vice versa. The number of cycles required is determined by the type and viscosity of the compounds to be mixed.

With viscous pharmaceutical substances, between 5 and 10 cycles of about 30 seconds are typically carried out according to this method, which corresponds to a total process time between 2 mins 30 and 5 mins. In the state of the art, a typical mixing time is 60 minutes.

The compounds of the mixture are introduced into the upper tank 1 before the mixing process is started by withdrawing the cover 12 or they are injected into the system during the mixing process by means of a sealed worm screw device (not shown in the figures) that may equally be positioned on the upper tank 1 or on the central mixing element 5.

Figure 3:
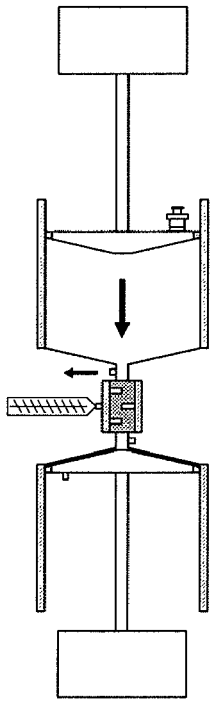
FIG. 3 diagrammatically represents the stage of draining the mixing device of the invention, which occurs once the desired homogeneity is achieved.

When the mixing process is completed, the system allows its complete draining as shown in FIG. 3. To this end, all the mixture is transferred in the upper 1 or lower 2 tank and then emptied out outwards.

The invention claimed is:

1. Automated method for mixing at least two viscous substances by means of a double-chamber mixing device comprising:
- a first tank and a second tank, that are cylindrical, coaxial and communicating, each sealingly closed at a first end with a moving piston and provided at its second end with a slightly tapered bottom, both tanks being positioned in mirror-image symmetry relative to a median plane that is perpendicular to their common axis;
- a central static mixing element connecting both tanks at the level of their slightly tapered bottoms; and
- a hydraulic device for automatically activating the pistons according to a coordinated reciprocal motion, wherein:
- the substances to be mixed are injected into the first tank or into the central static mixing element by sealed worm screw injection;
- a specified number of successive mixing cycles are achieved by pumping, said number being between 5 and 10 and the duration of each cycle being about 30 seconds, from the first tank towards the second tank through the central static mixer, and vice versa; and
- the final mixture is transferred to one of both tanks, which is then emptied.

2. Method as in claim 1, wherein the substances to be mixed comprise pharmaceutical compounds.

3. Double-chamber device for mixing at least two viscous substances comprising:
- a first tank and a second tank, that are cylindrical, coaxial and communicating, each sealingly closed at a first end with a moving piston and provided at its second end with a slightly tapered bottom, both tanks being positioned in mirror-image symmetry relative to a median plane that is perpendicular to their common axis;
- a central static mixing element connecting both tanks at the level of their slightly tapered bottoms;
- a hydraulic device for automatically activating the pistons according to a coordinated reciprocal motion and for controlling and synchronising the motions of the pistons according to mixing cycles and the injection of the substances to be mixed; and
- a sealed injector in the form of a worm screw device connected at the level of one of the tanks or of the central static mixing element.

4. Device as in claim 3, wherein the static mixing element comprises a series of baffles or a labyrinth.

5. Device as in claim 3, wherein the shape of each piston is also slightly tapered and adapted to the shape of the corresponding tank so as to allow the complete draining of said tank.

6. Device as in claim 3, wherein both tanks, the two corresponding pistons and the static mixing element are made of stainless steel.

7. Device as in claim 3, wherein both tanks and the static mixing element are thermostatically controlled by a double external casing in which a cooling or heating fluid may circulate.

8. Device as in claim 3, wherein the tapered shape of the bottom of each tank and of each respective piston is between 5 and 15°.

9. Device as in claim 3, wherein at least one of both tanks and the static mixing element are provided with a means for injecting or removing the substances to be mixed, measuring the temperature, creating a vacuum or introducing an inert gas or taking samples during mixing.

10. Device as in claim 9, wherein said means comprises an injection or removal system of a luer-lock type and valves.

* * * * *